United States Patent [19]

Biava et al.

[11] Patent Number: 4,799,712

[45] Date of Patent: Jan. 24, 1989

[54] PRESCRIPTION SHEET AND MEDICATION DISTRIBUTION SYSTEM

[75] Inventors: Richard D. Biava, Gaithersburg; Andrew J. Whelan, Germantown, both of Md.

[73] Assignee: Physicians' Pharmaceutical Services, Inc., Rockville, Md.

[21] Appl. No.: 932,026

[22] Filed: Nov. 18, 1986

[51] Int. Cl.[4] ..... B41L 1/22; B42D 15/00

[52] U.S. Cl. ..... 282/1 A; 283/81

[58] Field of Search ..... 283/1 A, 81, 82, 83; 282/1, 8 R, 9 R, 10 R, 12 R, 11 R, 11.5 A

[56] References Cited

U.S. PATENT DOCUMENTS

| | | | |
|---|---|---|---|
| Re. 30,958 | 6/1982 | White | 40/310 |
| 630,822 | 8/1899 | Bates . | |
| 3,494,059 | 8/1967 | Minasian | 40/306 |
| 3,625,547 | 12/1971 | Burke | 283/81 X |
| 4,029,341 | 6/1977 | Neill et al. | 282/22 R |
| 4,159,129 | 6/1979 | Lockhart | 283/81 X |
| 4,204,706 | 5/1980 | Blum et al. | 283/21 |
| 4,277,089 | 7/1981 | Lockhart | 283/81 X |
| 4,312,523 | 1/1982 | Haines | 283/81 X |
| 4,519,631 | 5/1985 | Stone et al. | 283/70 |
| 4,549,750 | 10/1985 | Stone et al. | 283/79 |
| 4,637,635 | 1/1987 | Levine | 283/81 X |

*Primary Examiner*—Paul A. Bell

*Attorney, Agent, or Firm*—Fleit, Jacobson, Cohn & Price

[57] ABSTRACT

When a prescription drug is to be dispensed to a patient according to the present invention, a physician, or anyone else legally able to prescribe and dispense prescription medications (legend drugs), has preprinted or fills in by writing or typing on a prescription sheet, such information as a prescribed medicine, prescribed dosage and frequency of use, drug dispensing identification number, date, name of the patient, and additional necessary information. The prescriber then signs the prescription sheet. According to the system of the invention, the prescriber dispenses or authorizes the dispensing of prepackaged medications without having to prepare a dispensing label or additional pharmacy records. Further, the system expedites the use of prepackaged drugs by pharmacists by combining a prescription sheet and dispensing label.

13 Claims, 3 Drawing Sheets

FIG. 6

INVENTORY CONTROL RECORD

60

Drug Name Amoxicillin Cap 250mg

Package Size 30

Price

| Date | Patient Name | Units Dispensed/ Inventory Added | Amount Remaining | Initials |
|---|---|---|---|---|
| 12/25/86 | John Doe | Rx Amoxicillin 25 mg 30½ | 40 | |

PRESCRIPTION SHEET AND MEDICATION DISTRIBUTION SYSTEM

BACKGROUND OF THE INVENTION

The dispensing of prescription drugs has traditionally been initiated by the filling in of a prescription form by a physician. The prescription form was then given to the patient. The patient would transmit the prescription form to a pharmacy where the prescription was filled by a pharmacist. The pharmacist would fill the prescription by placing a required amount of the prescribed drug in a container. The information contained on the presecription form written by the physician was then transferred by the pharmacist to a label. The label was secured to the container into which the prescribed drug had been dispensed. The prescription form written by the physician was then maintained in the pharmacist's records to accound for the distribution of the prescribed drug.

One disadvantage of this system is that the patient must transmit a prescription form from the physician to a pharmacy. In addition, the pharmacist must then transfer the information contained on the prescription form to a separate pharmaceutical label. The label is secured to the container in which the drugs have been dispensed. A separate record keeping entry of the drugs dispensed by the pharmacist is generated by the pharmacist.

U.S. Pat. No. 4,159,129 to Lockhart discloses a pharmaceutical record and label system. In the Lockhart system, a pharmacist transfers information from a prescription form signed by a physician to a formatted label. The filling in by the pharmacist of the label simultaneously provides a label for a container into which prescription drugs have been dispensed by the pharmacist and a backing sheet which records the label information and includes supplemental data segments for recording supplemental information.

Additional patents including a record and label system for transfer of information to a label from a prescription form which has been filled in and signed by a physician are U.S. Pat. No. 4,277,089 to Lockhart, U.S. Pat. No. 4,322,523 to Haines, U.S. Pat. No. 3,625,547 to Burke and U.S. Pat. No. 3,494,059 to Minasian.

These patents similarly show the transfer of information from a prescription form to a record keeping sheet independent of the prescription form. The record keeping sheet includes a label for a container into which prescription drugs have been dispensed by the pharmacist and provides a record of the information recorded on the prescription label as well as supplemental information.

To dispense prepackaged drugs, the prescriber needs to prepare a dispensing label, record the dispensing of the medication by making an entry on the patient's medical record, and, if required by law or for internal control, maintain a perpetual inventory of the drugs dispensed.

The disadvantages of this system are that it requires the physician to interrupt a patient consultation to obtain the medication, make the entries on the label and medical chart and to write a prescription if the medication is not available at his office.

SUMMARY OF THE PRESENT INVENTION

By the present invention, the disadvantages of the prior systems, including having prescriptions authorized by a physician or other authorized prescriber (hereafter "prescriber") and independently filled by a pharmacist or having the physician complete the label and make the appropriate record-keeping entries for prepackaged labels, are avoided. By the present invention, a unified prescription sheet for signature by a prescriber and pharmaceutical record and label system is provided. Additionally, the system expedites the use of prepackaged drugs by pharmacists by combining a prescription form and a dispensing label.

When a prescription drug is to be dispensed to a patient according to the present invention, a prescriber, or anyone else legally able to prescribe and dispense controlled substances and all legend drugs, fills in by writing or typing on a prescription sheet, such information as a prescribed medicine, prescribed dosage and frequency of use, drug dispensing identification number, date, name of the patient, and additional necessary information. The prescriber then signs the prescription. A legend drug is an item that has the following legend on the bottle "Caution: Federal law prohibits dispensing without prescription."

According to the system of the present invention, the prescriber or a pharmacist maintains a stock of prepackaged containers of prescription medicine which satisfy the Food and Drug Administration (FDA) requirements for prepackaged prescription medicine. The prepackaged containers typically contain the most commonly dispensed prescription medications prescribed by the physician. The containers contain a predetermined amount of medication which has been found to alleviate the particular symptoms for which the medication is prescribed.

A first removable label segment of the prescription sheet includes the name of the prescription drug, including any descriptive information regarding the size of an individual unit of the medicine prescribed, for example, 250 milligram tablet and the number of units to be diagnosed to the patient, for example, 30. On a second removable label segment, the physician fills in the name of the patient and the usage instructions for the medication.

The second label segment including the patient's name and the usage instructions for the drug is removed from the prescription sheet. The prescriber, his agent or a pharmacist or his agent then applies the label segment to the appropriate prepackaged prescription medicine containers which the physician or pharmacist maintains in stock.

A separate production label, already on the prepackaged prescription medicine container includes the number of units of medication contained, weight or volume of medicine in the container, manufacturer's name and address, lot number and expiration date, plus any other information required by the FDA, DEA or applicable statute or federal or state agency for prepackaged prescription drugs. For dosage and frequency of use instructions, the patient is referred to the separate label which has been applied by the physician, his agent or a pharmacist or his agent to the prepackaged medicine container.

The first label segment of the prescription sheet contains the name of the medication, strength, quantity and if elected, the therapeutic indication of the medication to be dispensed. The first label segment is removed from the prescription form and secured to a medical chart record of the physician's dispensary or on a patient's chart to indicate what medication has been prescribed.

Both label segments are made of a "carbonless" type paper so that all information written or typed onto the top surface is transferred to a backing sheet of the prescription sheet. The backing sheet from which the two label segments have been removed thereby provides a permanent record or what was written on the label segments which were removed from the backing sheet. Depending on the applicable state law, the backing sheet may be included in the patient's file or filed as a record for the physician or pharmacist of the prepackaged medication which was dispensed.

If the patient is to have their prescription filled at a pharmacy, the patient takes the prescription sheet of the present invention which has been filled in and signed by a prescriber and transmits it to a pharmacy for filling. The pharmacist enters a prescription number on the label and the prescription and logs the prescription in. The pharmacist then simply removes the label segment containing the patient's name, dosage, prescription number and frequency of use and applies the label segment to the container with the prescribed medication and retains the remainder of the form as his copy of the prescription.

According to the present invention, the physician or pharmacist applies the label segment to a container of prepackaged medication whereas a pharmacist would usually transfer medication from one container into another. The other label segment including the name of the medication and the units of dosage, is either removed by the physician and secured to the patient's chart prior to the patient leaving the physician's office or may remain with the prescription sheet when transmitted to an independent pharmacist.

If the medication is not being provided by the prescriber or affiliated pharmacy, the complete prescription sheet may be transmitted to an indpendent pharmacist as would any other prescription form.

The entire prescription sheet is assigned a number by the pharmacist and placed on file by the pharmacist or used as dictated by applicable law. The pharmacist is thereby freed from transferring information from a prescription sheet to another labelling system as was required in prior systems.

It is an object of the present invention to provide a prescription sheet which is filled in and signed by a prescriber and includes removable label segments which indicate the name of the patient, medication prescribed, dosage and frequency of use.

It is another object of the present invention to provide a prescription sheet having one or more removable label segments which, when filled in by a prescriber, transfers prescription information to a backing sheet.

It is yet another object of the present invention to provide a prescription sheet including a label segment which is transferable to a prepackaged container of prescription medicine and satisfies FDA, DEA, and other federal and state pharmacy requirements for dispensing of prescription drugs.

It is still another object of the present invention to provide a prescription sheet that includes the therapeutic indication for which the drug is being dispensed to facilitate drug audits.

It is yet still another object of the present invention to provide a prescription sheet having one or more removable label segments, one of which is applied to a prepackaged container of prescription drugs and another label segment which is applied to a medical chart of a patient or record of a dispensary of a prescriber.

These and other objects of the invention, as well as many of the intended advantages thereof, will become more readily apparent when reference is made to the following description taken in conjunction with the accompanying drawings.

BRIEF DESCRIPTION OF THE DRAWINGS

FIG. 6 is a plan view of a prescriber's inventory control record with a label segment from a prescription sheet.

DETAILED DESCRIPTION OF THE PREFERRED EMBODIMENTS

Figure 1:
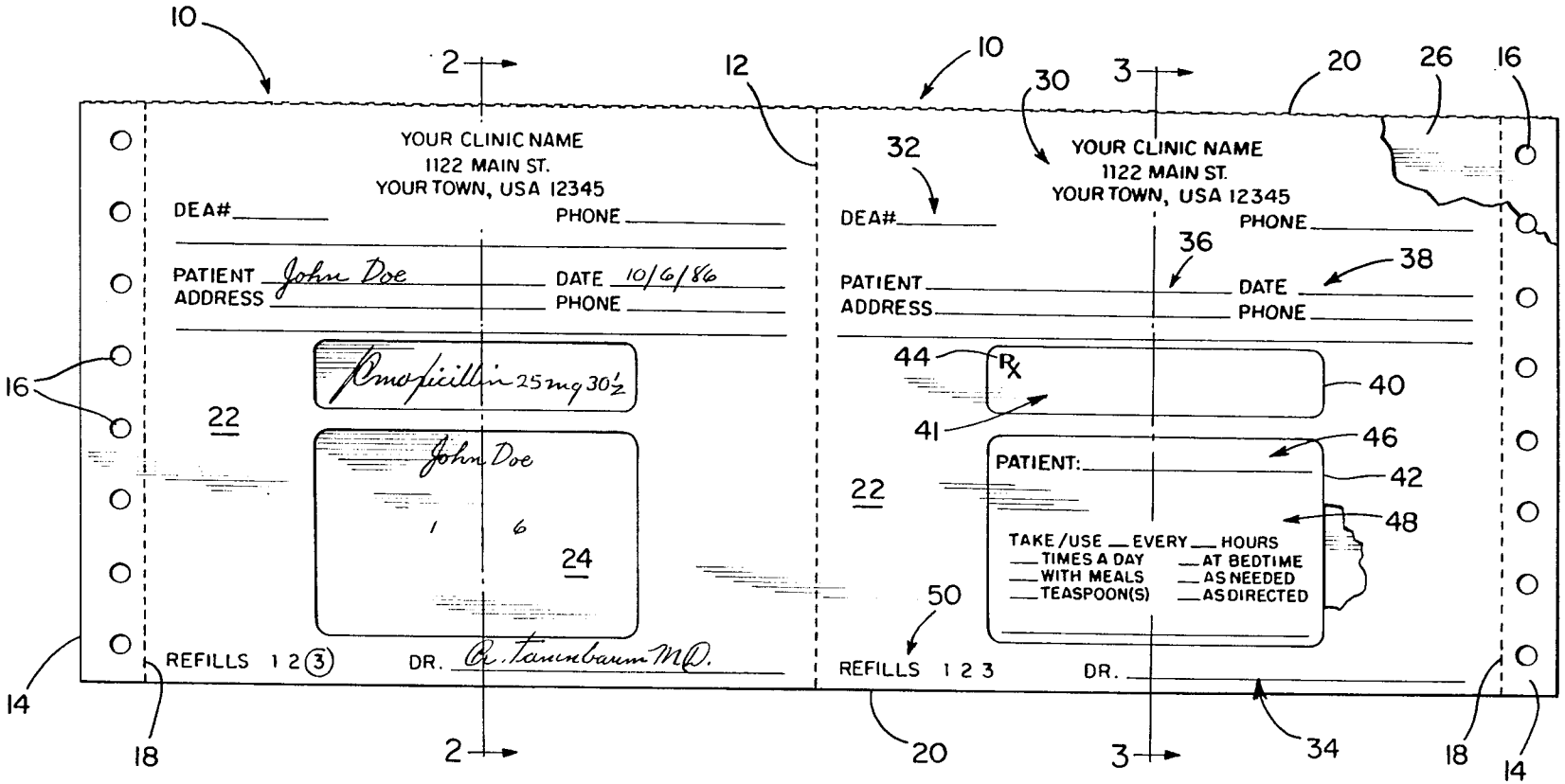
FIG. 1 is a top plan view of two prescription sheets

In describing the preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
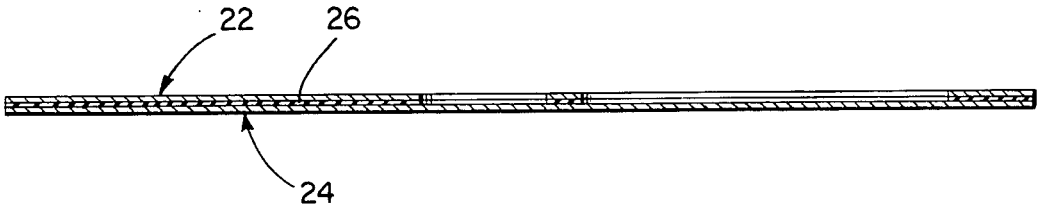
FIG. 2 is a longitudinal sectional view taken along line 2—2 of FIG. 1.
Figure 3:
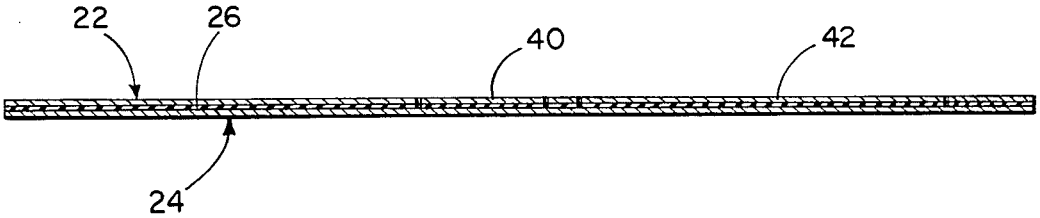
FIG. 3 is a longitudinal sectional taken along line 3—3 of FIG. 1.

With reference to the drawings, in general, and to FIGS. 1 through 3, in particular, two prescription sheets are shown, each generally designated as 10. The two sheets 10 measure approximately 4⅛ inches in width and 4 inches in height and are joined to each other along perforated line 12.

At opposite edges of the two sheets is a margin section 14 having guide holes 16. The margins 14 are attached to the sheets 10 by perforated lines 18. The margins 14 facilitate the formatted printing of the sheets 10 and the use of the sheets for computer generated printed information such as the name, address and telephone number of the prescriber. Perforated lines 20 extend across the top and bottom edges of the sheets 10 and margins 14 where it is envisioned that additional sheets 10 and margins 14 are secured for storage in a continuous roll or in folded sections. The prescription sheets are also contemplated as being available in a pad format.

Since prescription sheets are used for obtaining controlled substances and legend drugs, it is intended that the prescription sheets of this invention are to be made available to authorized prescribers with legend drug and controlled substance dispensing authority. It is also contemplated that the prescription sheets of this invention would be made available to those others who are authorized to prescribe prescription drugs.

Each sheet 10 includes a cover sheet 22 and a backing sheet 24. Interposed between each of the cover sheets and backing sheets is an adhesive layer 26, preferably rubber cement. The face of the backing sheet which is adjacent to the back of the cover sheet is of a smooth shiny consistency similar to wax paper to which the cover sheet is releasably secured by the adhesive layer 26. The adhesive layer 26 remains on the back of the cover sheet when sections of the cover sheet are removed from the backing sheet.

The cover sheet and backing sheet form a "carbonless" type paper system such that pressure applied to the cover sheet by a pen, pencil, typewriter or other object making an impression on the cover sheet will create a readable impression (usually of black or blue color) on the face of the backing sheet, identical to the impression made on the face of the cover sheet.

The face of the cover sheet is divided into a plurality of regions to record information. Region 30 includes the name, address and phone number of the prescription drug dispenser, whether it be a clinic or a doctor's office. Region 32 provides a legend for prompting insertion or preprinting of a drug enforcement agency number assigned to a physician for keeping track of prescriptions written by physicians. Region 34 provides a legend for prompting insertion of the signature of the authorized prescriber. Region 36 provides a legend for prompting insertion of the name, address and phone number of the patient, whereas region 38 provides a legend for prompting the insertion of the date on which the prescription sheet is issued by a physician.

Label segments 40 and 42 are separated from the remainder of the cover sheet 22 by a score line. Label segment 40 measures approximately 0.5 inches by 2.25 inches and includes the traditional Rx prescription sign 44. In region 41, the name of the medication, strength, unit of individual dosage and usage instructions are filled in by the physician. This information should coincide with the unit of individual dosage and total number of individual dosages contained within each container of prepackaged prescription medicine kept by the prescriber or clinic in its inventory.

On label segment 42, which measures 1.5 inches ×2.25 inches, is region 46 which includes legends for pormpting insertion of the patient's name and region 48 which includes legends for prompting insertion of the dosage and frequency of administration of the prescribed medication. In region 50, indication of permitted number of refills is circled, or written in (i.e. 6x) by the issuing physician.

After the face of the cover sheet is filled in and signed by the issuing physician, label segment 42 is peeled away from the backing sheet 24 and applied to a prepackaged container 52 of prescription drugs. Label segment 42 includes adhesive 26 and is thereby secured to container 52.

Container 52 is safely-sealed and contains a predetermined amount of a prescription drug and is properly labelled as required by all applicable statutes. The unit of an individual dose and total number of individual dosages in each prepackaged container should coincide with the unit of an individual dose and total number of individual dosages authorized by the prescriber, for the prepackaged container to be properly dispensed.

The prescriber or pharmacist maintaining a stock of prepackaged prescription drugs removes one container 52 from his inventory and attaches label segment 42, thereby satisfying the requirements for dispensing of prescription drugs. The patient is then given the container 52 without the need for the transfer of the prescription information from the prescription sheet to a separate pharmacist record and label system.

When filling in label segment 40 and 42 adhered to backing sheet 24, the information filled in on lable segments 40 and 42 is transferred to backing sheet 24, as is shown in the left hand sheet 10 of FIG. 1. Upon removal of label segments 40 and 42, the prescriber or pharmacist still has a record of the prescription issued to a patient which has been recorded on the backing sheet.

Figure 4:
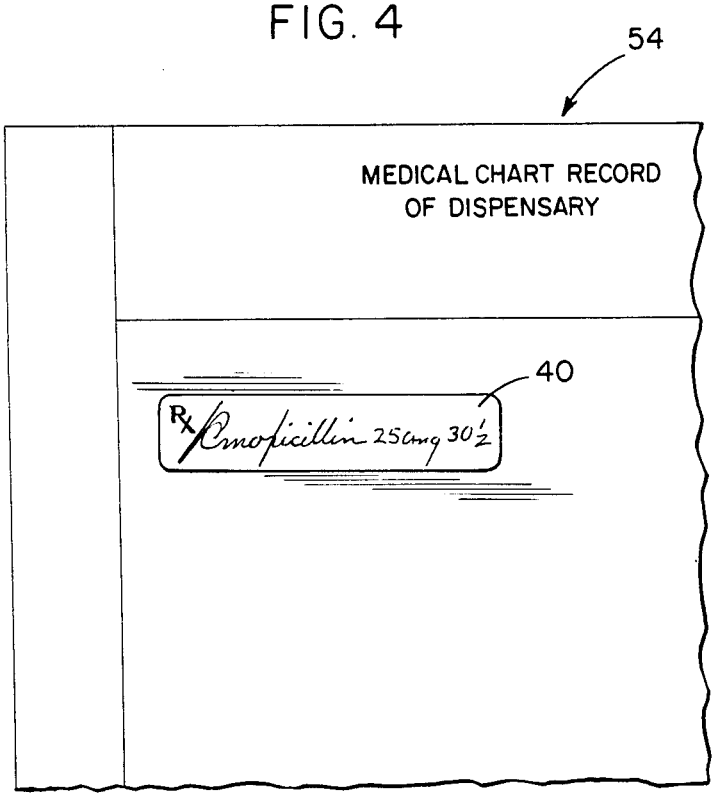
FIG. 4 is a plan view of a medical chart record of a dispensary with a label segment from a prescription sheet.
Figure 5:
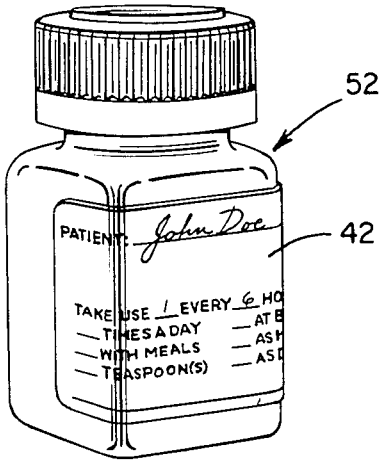
FIG. 5 is a side view of a prepackaged container of prescription drugs with a label segment from a prescription sheet.

Label segment 40 containing the name, individual dosage and total number of individual dosages of the prescription drug is transferred to a medical chart record of dispensary 54 as shown in FIG. 4 or to inventory control record 60 as shown in FIG. 6 to maintain a record of prepackaged containers removed from inventory or label segment 40 is transferred to the patient's chart as a record of prescribed medication issued or prescribed to the patient. The adhesive 26 on the rear face of label segments 40 and 42 facilitates the securing of the label segments 40 and 42 to the container 52 and medical chart 54 (or record 60), respectively.

Having described the invention, many modifications thereto will become apparent to those skilled in the art to which is pertains without deviations from the spirit of the invention as defined by the scope of the appended claims.

We claim:

1. A unified prescription sheet and phamaceutical record system for authorizing distribution of a prescription drug to a patient, said prescription sheet comprising:

a backing sheet, a cover sheet secured to said backing sheet, said cover sheet and said backing sheet including transfer means for transferring impressions made on said cover sheet to said backing sheet, and said cover sheet including preprinted regions for prompting entry of information required for dispensing of prescription drugs, one of said preprinted regions being a legend for prompting the signature of an individual authorized to prescribe prescription drugs, and adhesive means for releasably securing at least a portion of said cover sheet to said backing sheet.

2. A prescription sheet as claimed in claim 1, wherein a first label segment of said cover sheet includes a legend for prompting entry of a patient's name and entry of a prescribed dosage and frequency of administration.

3. A prescription sheet as claimed in claim 2, wherein a second label segment of said cover sheet includes a legend for prompting entry of the name of the prescribed medication.

4. A prescription sheet as claimed in claim 1, wherein at least one label segment of said cover sheet includes legends for prompting entry of a prescribed dosage and frequency of administration of a prescription drug.

5. A unified prescription sheet and pharmaceutical record system for authorizing distribution of a prescription drug to a patient, said prescription sheet comprising:

a backing sheet, a cover sheet, transfer means for transferring impressions made on said cover sheet to said backing sheet, adhesive means for releasably securing at least a portion of said cover sheet to said backing sheet, and preprinted regins of said cover sheet for prompting entry of information required for a dispensing of prescription drugs including legend for prompting the signature of an individual authorized to prescribe prescription drugs.

6. A prescription sheet as claimed in claim 5, wherein a first label segment of said cover sheet includes a legend for prompting entry of a patient's name and entry of a prescribed dosage and frequency of administration.

7. A prescription sheet as claimed in claim 6, wherein a second label segment of said cover sheet includes a legend for prompting entry of the name of the prescribed medication.

8. A prescription sheet as claimed in claim 5, wherein at least one of two label segments of said cover sheet includes legends for prompting entry of a prescribed dosage and frequency of administration of a prescription drug.

9. A system for dispensing of prescription drugs, said system comprising:

a unified prescription sheet and pharmaceutical record and label system including preprinted regions for prompting entry of information required for dispensing of prescription drugs and a removable label segment including a legend for prompting entry of the signature of an individual authorized to prescribe prescription drugs, a container containing a predetermined quantity of prescription drugs and having a prepackage label satisfying the requirements for prepackaged prescription drugs, said removable label segment being adapted to be applied to said container for dispensing of said container to a patient.

10. A system as claimed in claim 9, wherein said prescription sheet includes a cover sheet and a backing sheet with transfer means for transferring impressions made on said cover sheet to said backing sheet.

11. A system as claimed in claim 10, wherein said removable label segment includes adhesive means securing said label segment to said container.

12. A system as claimed in claim 9, wherein another removable label segment of said cover sheet includes a legend for prompting entry of a name of a prescription drug and a quantity of said prescription drug to be dispensed to a patient.

13. A system as claimed in claim 12, wherein said predetermined quantity of prescription drugs in said container is substantially equal and is the same drug as said prescription drug entered on said another lable segment.

* * * * *